US005232295A

United States Patent [19]

Andou et al.

[11] Patent Number: 5,232,295

[45] Date of Patent: Aug. 3, 1993

[54] WIRE PRINT HEAD AND PROCESS FOR FABRICATING IT

[75] Inventors: Hirokazu Andou; Mitsuru Kishimoto; Masahiro Tatsukami, all of Tokyo, Japan

[73] Assignee: Oki Electric Industry Co., Ltd., Tokyo, Japan

[21] Appl. No.: 759,161

[22] Filed: Sep. 13, 1991

[30] Foreign Application Priority Data

Sep. 18, 1990 [JP] Japan ..... 2-246125

[51] Int. Cl.[5] ..... B41J 2/28

[52] U.S. Cl. ..... 400/124; 29/608

[58] Field of Search ..... 400/124, 121, 157.2, 400/157.3; 29/608, 607; 101/93.29, 93.48

[56] References Cited

U.S. PATENT DOCUMENTS

| | | | |
|---|---|---|---|
| 4,225,250 | 9/1980 | Wagner et al. | 400/124 |
| 4,921,364 | 5/1990 | Yasunaga | 400/124 |
| 4,944,615 | 7/1990 | Kato et al. | 400/124 |
| 5,040,286 | 8/1991 | Stark | 29/598 |
| 5,152,217 | 10/1992 | Farb et al. | 400/124 |

FOREIGN PATENT DOCUMENTS

| | | |
|---|---|---|
| 1298824 | 6/1962 | France . |
| 1348745 | 12/1963 | France . |
| 2632788 | 12/1989 | France . |
| 55-066271 | 5/1980 | Japan . |
| 59-146032 | 2/1984 | Japan . |
| 60-214517 | 10/1985 | Japan . |
| 62-224916 | 10/1987 | Japan . |
| 63-128608 | 6/1988 | Japan . |

*Primary Examiner*—David A. Wiecking

*Attorney, Agent, or Firm*—Spencer, Frank & Schneider

[57] ABSTRACT

A permanent magnet suitable for use in a wire print head is formed of plural split segments. Each split segment is formed by compressing metal powder in a punching direction in the presence of a magnetic field that is perpendicular to the punching direction. The split segments are combined together into an annular configuration. The permanent magnet so formed is attached to a base, followed by the assembly of a base plate and cores to form a magnet assembly. The base plate and the cores are then surface-finished so as to be flush relative to each other.

20 Claims, 6 Drawing Sheets

WIRE PRINT HEAD AND PROCESS FOR FABRICATING IT

BACKGROUND OF THE INVENTION i) Field of the Invention

This invention relates to a print head which prints by driving print wires that are fixed on the free ends of respective armatures, and also to a process for fabricating the print head. In particular, this invention is concerned with a print head which includes an annular permanent magnet that is formed by a combination of split segments, and also with a process for making the magnet.

ii) Description of the Related Art

Impact printers of the type in which print wires are driven to strike a printing medium via an ink ribbon and printing is performed by the striking force are used in a wide variety of fields, led by output devices in information processing systems, owing to high freedom in the printing media that can be used and relatively low price.

Depending on the designs of their wire print heads, these impact printers can be classified into three types: the plunger type, the spring charge type, and the clapper type.

The spring charge type of print head has armatures with corresponding wires fixed thereon. The armatures are supported by respective biasing leaf springs, and normally attracted to respective cores against the resilient forces of the associated biasing leaf springs by a permanent magnet. During printing, a coils wound on the cores are energized to produce a magnetic flux in a direction opposite to that of the permanent magnet and hence to release the associated armatures. There has been an ever increasing demand for speeding-up the printing process in recent years so that wire print heads of the spring charge type, which feature good high-speed response, have been extensively adopted.

SUMMARY OF THE INVENTION

An object of the present invention is therefore to increase the magnetomotive force of a permanent magnet, thereby providing a small-size and light-weight wire print head. Another object of the present invention is to provide a fabrication process for such a wire print head.

The present invention therefore provides a wire print head comprising:

(a) armatures with respective print wires fixed on the ends thereof, (b) biasing leaf springs with the respective armatures secured thereon so that the leaf springs are supported in a cantilever fashion, (c) cores arranged in an opposing relationship with the respective armatures, (d) a permanent magnet inducing a magnetic flux so that the armatures are attracted on to the corresponding cores against the resilient force of the corresponding biasing leaf springs, and (e) coils wound on the respective cores, each of said coils being provided for selective energization so that a magnetic flux can be produced from the corresponding core to cancel out the magnetic flux induced by the permanent magnet and to release the corresponding armature from the associated core;

wherein said permanent magnet is formed of plural split segments, each of said plural segments having been produced in a magnetic field while maintaining a punching direction at a right angle relative to the direction of the magnetic field so as to have individual magnetic domains aligned with a direction of easy magnetization.

The present invention also provides a process for the fabrication of a wire print head having armatures with respective print wires fixed on the ends thereof, biasing leaf springs with the respective armatures secured thereon so that the leaf springs are supported in a cantilever fashion, cores arranged in an opposing relationship with the respective armatures, a permanent magnet inducing a magnetic flux so that the armatures are attracted to the corresponding cores against the resilient force of the corresponding biasing leaf springs, a base plate provided between the respective leaf springs and the permanent magnet, and coils wound on the respective cores, each of said coils being provided for selective energization so that a magnetic flux can be produced from the corresponding core to cancel out the magnetic flux induced by the permanent magnet and to release the corresponding armature from the associated core, which comprises the following consecutive steps:

(a) forming and magnetizing plural segments in a magnetic field while maintaining a punching direction at a right angle relative to the direction of the magnetic field so as to have individual magnetic domains aligned with a direction of easy magnetization;

(b) combining the individual segments together into the permanent magnet; and (c) assembling the base plate and the cores relative to the permanent magnet to form a magnet assembly.

BRIEF DESCRIPTION OF THE DRAWINGS

The above and other objects, features and advantages of the present invention will become apparent from the following description and the appended claims, taken in conjunction with the accompanying drawings, in which:

FIGS. 4(A) and 4(B) show how to assemble the split segments into the annular permanent magnet, in which FIG. 4(A) is a perspective view of the annular permanent magnet and FIG. 4(B) is a side view of the annular permanent magnet;

DETAILED DESCRIPTION OF THE PREFERRED EMBODIMENTS

Figure 1:
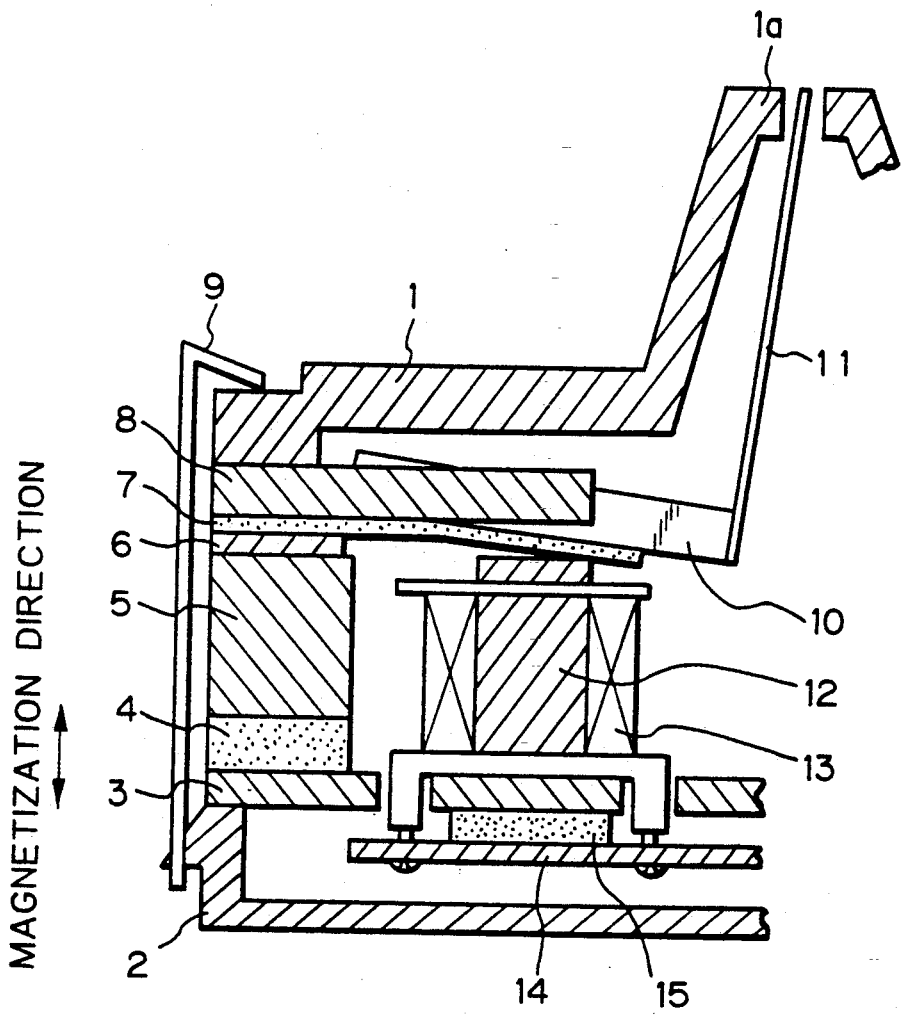
FIG. 1 is a fragmentary cross-sectional view of a wire print head according to one embodiment of the present invention.
Figure 2:
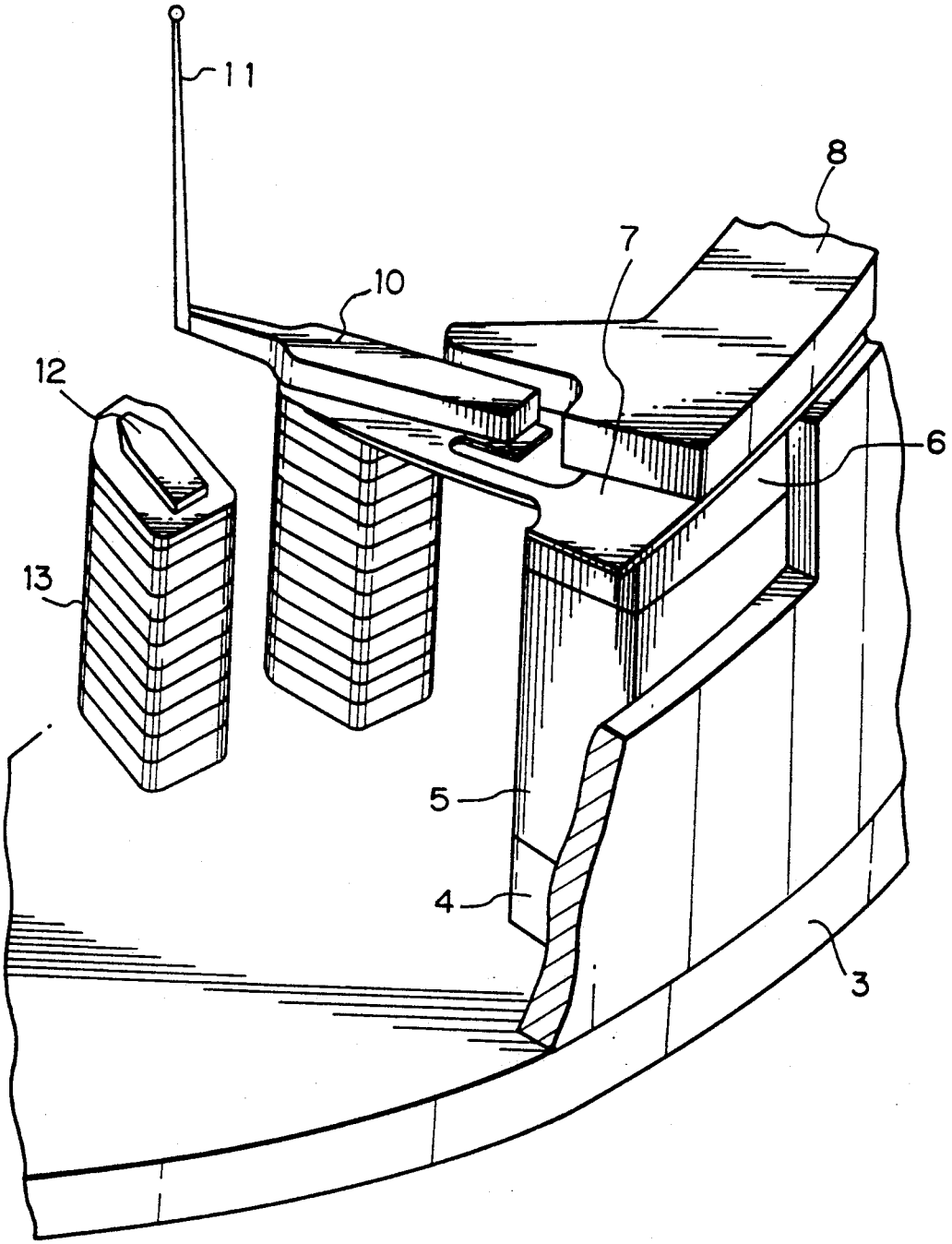
FIG. 2 is a partly cut-away, fragmentary, perspective view of the wire print head of FIG. 1.

Referring first to FIGS. 1 and 2, a base 3, an annular permanent magnet 4, a base plate 5, a spacer 6, a biasing leaf spring 7 and a yoke 8 are successively stacked one over another between a guide frame 1 and a cap 2. The double-headed arrow indicates the direction of magnetization of the permanent magnet 4. An armature 10 is provided at each flexible portion of the biasing leaf spring 7. A print wire 11 is fixed at a base portion thereof on a free end of the armature 10 so that a free end portion of the print wire 11 can project out toward a platen (not shown) while being guided by an associated guide 1*a*. Each core 12 is provided centrally on the base 3 and a coil 13 is wound around the core 12. Provided underneath the base 3 is a circuit board 14 Which serves to energize the coil 13 by way of a positioning space sheet 15.

In the wire print head of the construction described above, the magnetic flux of the permanent magnet 4 flows through the base plate 5, spacer 6, yoke 8, armature 10, core 12 and base 3 and returns to the permanent magnet 4, whereby a magnetic circuit is formed. By this magnetic circuit, the armature 10 is attracted on the core 12 so that strain energy is accumulated on the biasing leaf spring 7 to hold the leaf spring 7 in a biased state.

When the coil 13 is energized in this, biased state, a magnetic flux is produced in a direction opposite to the magnetic circuit, and the force by which the armature 10 is attracted is reduced. As a consequence, the strain energy accumulated on the biasing leaf spring 7 is released and the biasing leaf spring 7 moves to its home position, whereby the print wire 11 fixed on the free end of the armature 10 is caused to project out through the guide 1*a* and an ink ribbon (not illustrated) and printing medium (not illustrated) are pressed against a platen (not illustrated). As a result, a character or graphic pattern can be printed.

Figure 3:
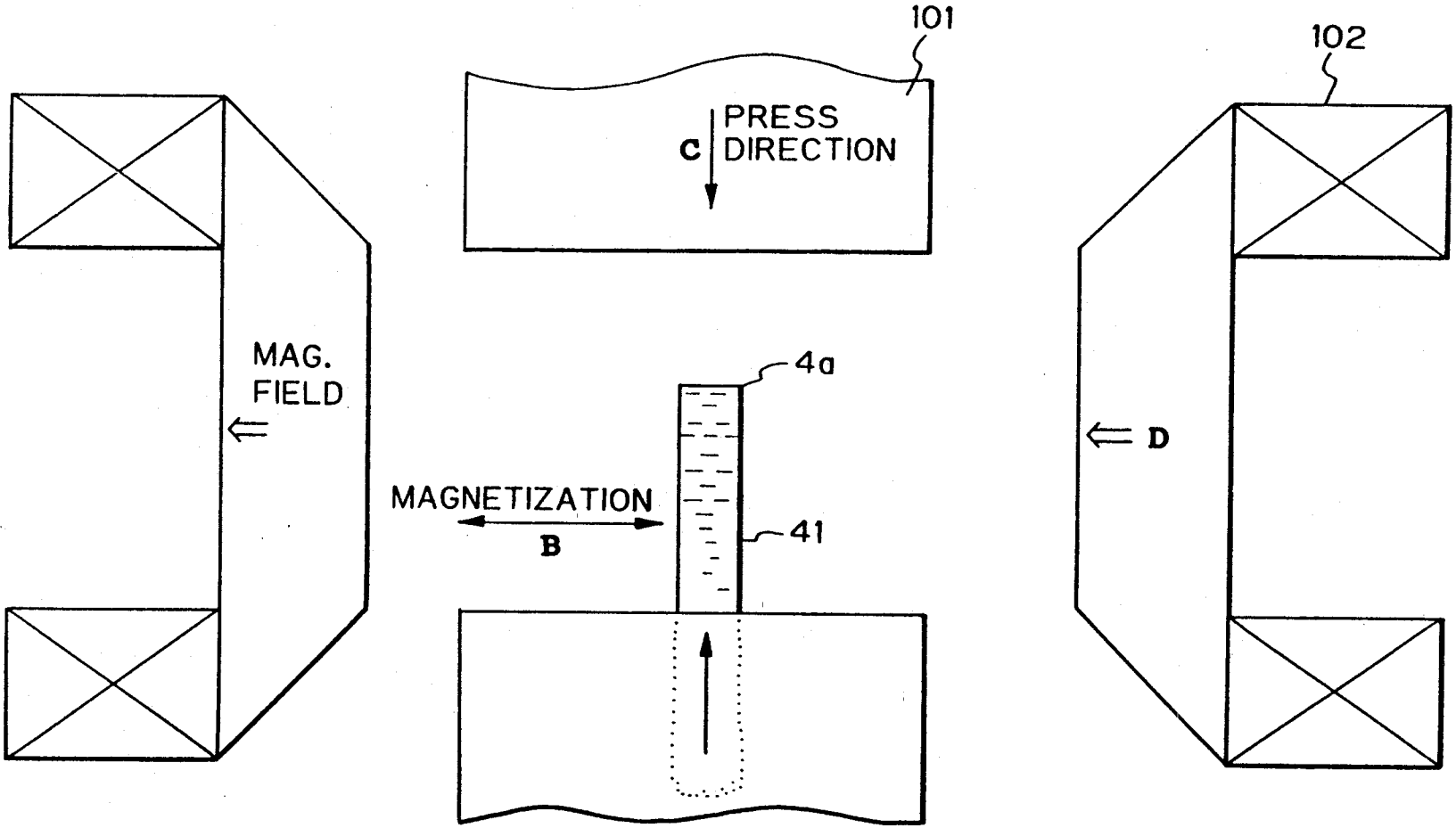
FIG. 3 schematically illustrates the production of each split segment of an annular permanent magnet in accordance with a fabrication process of the present invention for the production of the wire print head.

Referring next to FIG. 3, the production of each split segments which are combined to form the annular permanent magnet 4 will be described. Shown in the drawings are a split segment 4*a* of the permanent magnet 4, magnetic domains 41 of the permanent magnet 4, a punch 101 for shaping the split segment 4*a*, and magnetic field coils 102 for producing a magnetic field.

Split segments 4*a* have a shape corresponding to that obtained by splitting the permanent magnet 4 into two or more equal segments. The magnetic field is formed so that the axis B of easy magnetization of the split segment 4*a* extends at a right angle relative to a punching direction C. Since the punching direction C and the direction D of the magnetic field extend at a right angle relative to each other, the magnetic domains 41 inside the split segment 4*a* of the permanent magnet 4 tend to align in the direction D of the magnetic field. As a result, the residual magnetic flux density Br of the annular permanet magnet 4 is greater by as much as about 10% than that of a permanent magnet formed without making the punching direction C perpendicular to the direction D of the magnetic field.

Figure 4A:
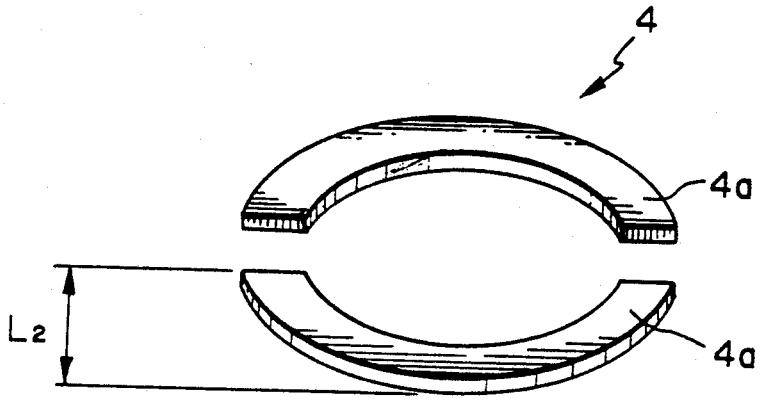
Figure 4B:
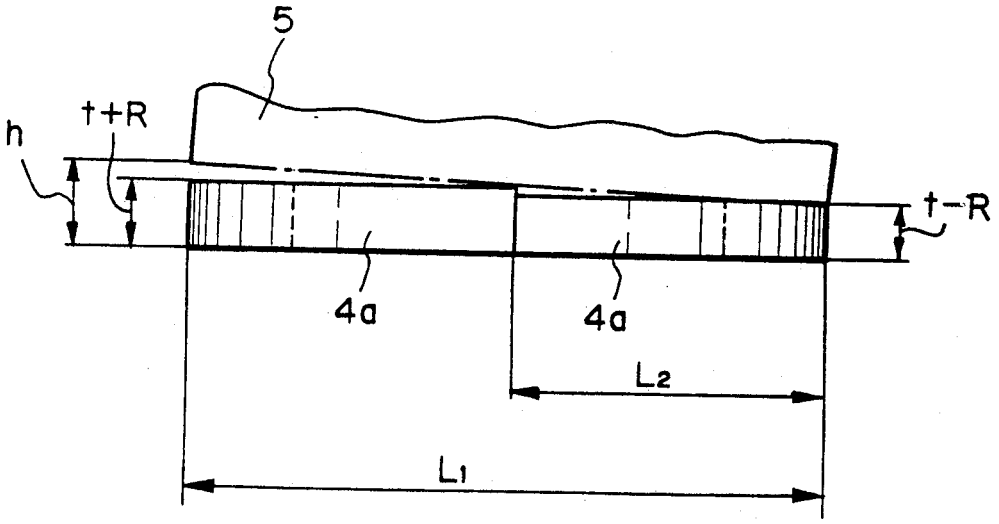

As is illustrated in FIGS. 4(A) and 4(B), the permanent magnet 4 is formed by combining the split segments 4*a*. The thickness of each split segment 4*a* can be represented by $t \pm R$, where $\pm R$ is the tolerance. The largest thickness difference of the permanent magnet 4, which may occur when the split segments 4*a* combined together, will be $(t+R)-(t-R)=2R$.

When the permanent magnet 4 is formed of two equal halves, the following relationship can be obtained:

$$L_1/L_2=2$$

where $L_1$ is the diameter of the permanent magnet 4, which has been obtained by combining the two split segments 4*a*, and $L_2$ is the length of each split segment 4*a* in a shorter direction. Supposing as shown in FIG. (B) that the thickness of one of the split segments 4*a* is $t+R$ and that of the other split segment 4*a* is $t-R$, the maximum lift h of the base plate 5 fixed on the permanent magnet 4 can be represented as follows:

$$h=2\times 2R=4R$$

Incidentally, the spacer 6 on the base plate 5 determines the attraction stroke of the armature 10 when it is attracted by the core 12. Further, to minimize variations in the attraction strokes among 7–24 biasing leaf springs 7, the upper surfaces of the base plate 5 and cores 12 are finished in flush relative to each other by grinding, lapping or the like.

Figure 5:
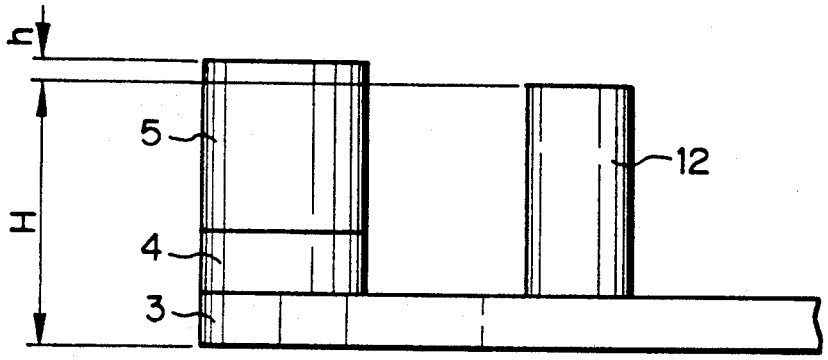
FIG. 5 schematically depicts one possible state of a magnet assembly before finishing.
Figure 6:
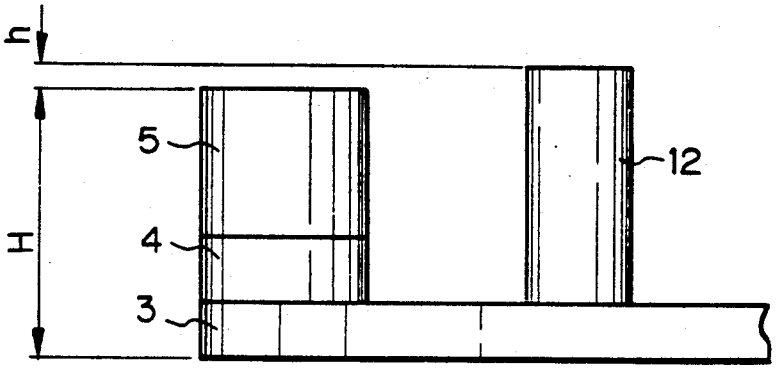
FIG. 6 schematically shows another possible state of the magnet assembly before finishing.

Because the base plate 5 may be lifted as much as 4R at the maximum by the split permanent magnet 4, it is possible to finish the upper surfaces of the base plate 5 and cores 12 in flush provided that, as shown in FIGS. 5 and 6, a necessary height H is assured for the magnet assembly, with spaces defined for coils, and the base plate 5 or cores 12 are provided with a machining allowance of $h=4R$ or greater.

In FIG. 5, the height of a core 12 when mounted on the base 3 is represented by H, which is the height needed for the magnet assembly, whereas the height of the base plate 5 when the permanent magnet 4 and the base plate 5 are mounted on the base 3 is represented by $H+h$. In this case, any lift produced upon arrangement of the split segment 4*a* on the base 3 can be avoided by eliminating the machining allowance of the base plate 5 by grinding, lapping or the like.

Turning next to FIG. 6, the height of a core 12 when mounted on the base 3 is represented by $H+h$, which is the sum of the height H needed for the magnet assembly and the maximum lift h of the base plate 5. The height of the base plate 5 when the permanent magnets 4 and the base plate 5 are mounted on the base 3 is represented by H. In this case, any lift produced upon arrangement of the split segments 4*a* on the base 3 can be avoided by eliminating the machining allowance of the cores 12 by grinding, lapping or the like.

Figure 7:
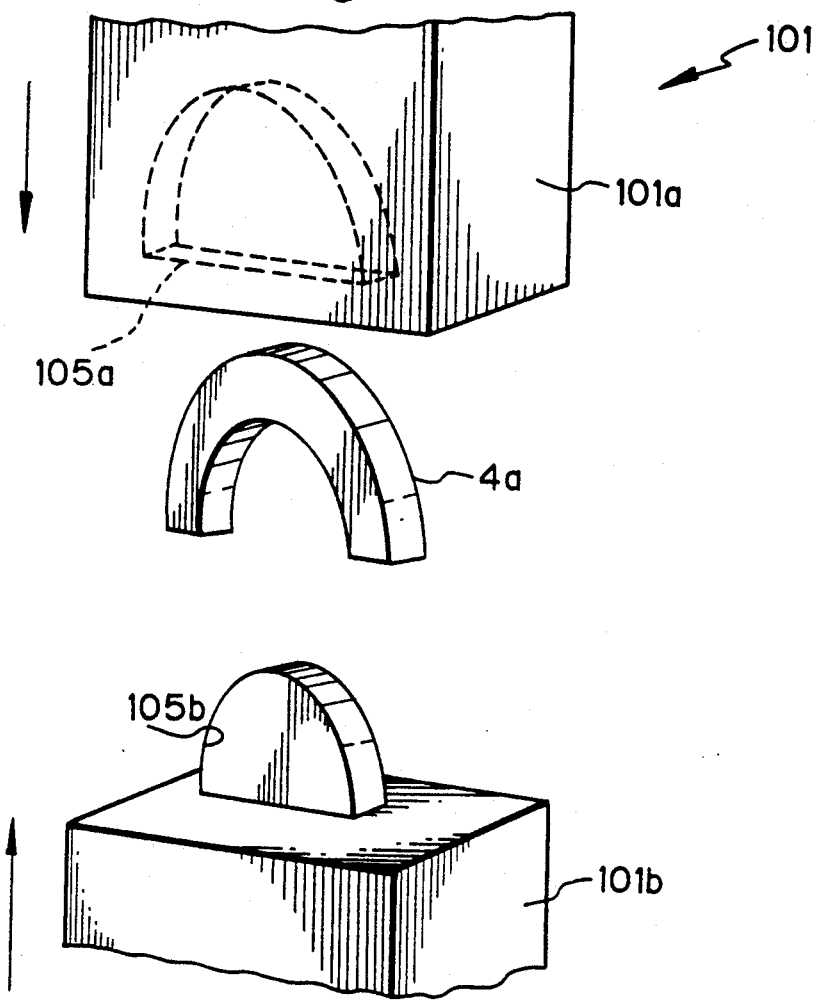
FIG. 7 is a schematic perspective view of a punch.

Referring now to FIG. 7, a punch for forming each split segment 4*a* of the permanent magnet 4 will be described. The punch, designated by numeral 101, is constructed of a top die 101*a* and a bottom die 101*b*. The top die 101*a* defines a recess 105*b* having the same size as the outer periphery of the split segment 4*a*. On the other hand, a head 105*b* having the same size as the inner periphery of the split segment 4*a* is formed on the bottom die 101*b*. When the recess 105*a* and the head 105*b* are brought into engagement, a cavity having the same dimensions and shape as the split segment 4*a* is formed.

A powder metal is placed inside the cavity and then pressed, whereby forming is conducted.

Figure 8:
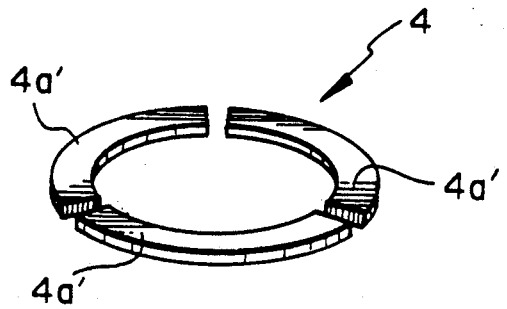
FIG. 8 is a perspective view of a permanent magnet in a wire print head according to another embodiment of the present invention.

The permanent magnet 4 shown in FIG. 8 is formed of three split segments 4*a*'. Similarly to the production of the permanent magnet formed from the two split segments 4*a*, the split segments 4*a*'are each formed and magnetized by making the direction of a magnetic field, which is produced to have magnetic domains aligned in a direction of easy magnetization, perpendicular to a punching direction. These three split segments 4*a*'are combined together to produce a permanent magnet.

Because each split segment of a permanent magnet is formed by making the direction of a magnetic field, which is produced to have magnetic domains aligned with an axis of easy magnetization, perpendicular to a punching direction as has been described above in detail, the direction of the magnetic domains so aligned does not become equal to the punching direction and a high residual magnetic flux density is obtained.

Further, the split segments are combined together into the annular permanent magnet, the permanent magnet is mounted on the base, the base plate is assembled in to form a magnet assembly, and surfaces of the base plate and cores are finished so as to be flush relative to each other. Since, the surfaces of the base plate and cores are finished so as to be flush relative to each other, even if the base plate is lifted by a difference in thickness of the split segments, this lift can be eliminated.

What is claimed is:

1. A wire print head comprising:

armatures with ends, print wires, each fixed to the end of a respective armature, biasing leaf springs with respective armatures secured thereon so that the leaf springs are supported in a cantilever fashion, cores arranged in an opposing relationship with the respective armatures, an annular permanent magnet inducing a magnetic flux so that the armatures are attached to the corresponding cores against the resilient force of the corresponding biasing leaf springs, and coils wound on the respective cores, each of said coils being provided for selective energization so that a magnetic flux can be produced from the corresponding core to cancel out the magnetic flux induced by the permanent magnet and to release the corresponding armature from the associated core;

wherein said permanent magnet is formed of split segments, the number of split segments being smaller than the number of armatures, each of said split segments having been produced by compressing metal powder in a punching direction in the presence of a magnetic field at a right angle relative to the punching direction so as to provide individual magnetic domains aligned with a direction of easy magnetization.

2. The wire print head of claim 1, wherein said permanent magnet is formed of two split segments.

3. The wire print head of claim 1, wherein said permanent magnet is formed of three split segments.

4. The wire print head of claim 1, wherein the cores are parallel to one another, and wherein the permanent magnet has a direction of magnetization that is parallel to the cores.

5. A process for the fabrication of a wire print head having armatures with ends, print wires fixed on the ends of respective armatures, biasing leaf springs with the respective armatures secured thereon so that the leaf springs are supported in a cantilever fashion, cores arranged in an opposing relationship with the respective armatures, an annular permanent magnet inducing a magnetic flus so that the armatures are attracted to the corresponding cores against the resilient force of the corresponding biasing leaf springs, a base plate provided between the respective leaf springs and the permanent magnet, and coils wound on the respective cores, each of said coils being provided for selective energization so that magnetic flux can be produced from the corresponding core to cancel out the magnetic flux induced by the permanent magnet and to release the corresponding armature from the associated core, which comprises the following steps:

(a) forming and magnetizing a plurality of segments by compressing metal powder in a punching direction in the presence of a magnetic field at a right angle relative to the punching direction so as to provide individual magnetic domains aligned with a direction of easy magnetization;

(b) combining individual segments together to form the annular permanent magnet, the number of segments that are combined to form the annular permanent magnet being smaller than the number of armatures; and (c) assembling the base plate and the cores relative to the permanent magnet to form a magnet assembly.

6. The process of claim 5, further comprising the step of surface-finishing the base plate and the cores so that they are flush relative to each other.

7. The process of claim 5, wherein the segments that are formed and magnetized during step (a) are semicircular, and wherein step (b) is conducted by combining two of the segments to form the annular permanent magnet.

8. The process of claim 5, wherein the segments that are formed and magnetized during step (a) subtend a third of a circle, and wherein step (b) is conducted by combining three of the segments to form the annular permanent magnet.

9. The process of claim 5, wherein the cores are mounted parallel to one another and the permanent magnet is magnetized in a direction parallel to the cores, wherein each segment that is formed and magnetized during step (a) has a pair of opposite sides and an arcuate outer periphery which extends from one of the opposite sides to the other, and wherein step (a) is conducted with the punching direction directed toward the arcuate outer periphery and with the magnetic field oriented transverse to the sides.

10. A wire print head fabricated by the process of claim 5.

11. A process for the production of an annular permanent magnet suitable for use in a wire print head, which comprises the following consecutive steps:

(a) forming and magnetizing plural split segments, which have a shape and dimensions to make up the annular configuration of the permanent magnet when combined together, by compressing metal powder in a punching direction in the presence of a magnetic field at a right angle relative to the punching direction so as to provide individual magnetic domains aligned with a direction of easy magnetization; and (b) combining a predetermined number of the individual split segments together into the annular permanent magnet, the predetermined number being no greater than three.

12. The process of claim 11, wherein the split segments formed during step (a) are semicircular, and wherein step (b) is conducted by combining two of the split segments to form the annular permanent magnet.

13. The process of claim 11, wherein the split segments formed during step (a) subtend a third of a circle, and wherein step (b) is conducted by combining three of the split segments to form the annular permanent magnet.

14. The process of claim 11, wherein each split segment that is formed and magnetized during step (a) has a pair of opposite sides and an arcuate outer periphery which extends from one of the opposite sides to the other, and wherein step (a) is conducted with the punching direction directed toward the arcuate outer periphery and with the magnetic field oriented transverse to the sides.

15. An annular permanent magnet produced by the method of claim 11.

16. A process for producing, by a punch, an annular permanent magnet suitable for use in a print head, said punch having a first die and second die arranged in an up-and-down, engageable relationship, said first die defining a recess of a shape corresponding to that obtained by splitting a disk into segments of equal configuration and dimensions, said second die having a head of a shape corresponding to that obtained by splitting another disk, which has a smaller diameter than the first-mentioned disk, into segments of equal of equal configuration and dimensions, which comprises the following steps:

(a) placing a powder metal between the recess and the head;

(b) punching the powder metal in a punching direction by the first die and the second die and, at the same time, producing by a pair of magnetic field coils a magnetic field across the powder metal in a direction perpendicular to the punching direction;

(c) repeating steps (a) and (b) at least once to provide a plurality of split segments; and (d) combining the a predetermined number of the split segments into the single annular permanent magnet, the predetermined number being no greater than three.

17. The process of claim 16, wherein the split segments are semicircular, and wherein step (d) is conducted by combining two split segments to form the annular permanent magnet.

18. The process of claim 16, wherein the split segments subtend a third of a circle, and wherein step (d) is conducted by combining three split segments to form the annular permanent magnet.

19. The process of claim 16, wherein each split segment has a pair of opposite sides and an arcuate outer periphery which extends from one of the opposite sides to the other, and wherein step (b) is conducted with the punching direction directed toward the arcuate outer periphery and with the magnetic field oriented transverse to the sides.

20. An annular permanent magnet produced by the process of claim 16.

* * * * *